US005429107A

United States Patent [19]

Troncoso, Jr.

[11] Patent Number: 5,429,107

[45] Date of Patent: Jul. 4, 1995

[54] ARCHERY ARROW REST WITH DETACHABLE LAUNCHER ARM

[76] Inventor: Fernando Troncoso, Jr., 1665 Hermosa Ct., Montrose, Colo. 81401-6417

[21] Appl. No.: 151,977

[22] Filed: Nov. 15, 1993

[51] Int. Cl.[6] ..... F41B 5/22

[52] U.S. Cl. ..... 124/44.5; 124/24.1

[58] Field of Search ..... 124/23.1, 24.1, 25.6, 124/44.5, 86, 88

[56] References Cited

U.S. PATENT DOCUMENTS

| | | | |
|---|---|---|---|
| 4,398,528 | 8/1983 | Troncoso | 124/24.1 |
| 4,476,846 | 10/1984 | Carville | 124/44.5 |
| 4,664,093 | 5/1987 | Nunemaker | 124/24.1 |
| 4,715,355 | 12/1987 | Lattig | 124/44.5 |
| 4,748,964 | 6/1988 | Troncoso | 124/44.5 |
| 4,827,895 | 5/1989 | Troncoso | 124/44.5 |
| 4,899,716 | 2/1990 | Martin et al. | 124/44.5 |
| 5,062,407 | 11/1991 | Newbold | 124/44.5 |
| 5,070,855 | 12/1991 | Troncoso | 124/44.5 |
| 5,117,803 | 6/1992 | Johnson | 124/44.5 |
| 5,213,090 | 5/1993 | Tone | 124/44.5 |

*Primary Examiner*—Dave W. Arola
*Assistant Examiner*—John A. Ricci
*Attorney, Agent, or Firm*—Donald E. Nist

[57] ABSTRACT

The improved rest features a detachable launcher arm having a launching tip of hard metal such as stainless steel or the like, or of cermet or ceramic which is resistant to wear from carbon and other abrasive arrows. The rest includes a mounting block which extends rearwardly behind the handle of an archery bow and to which is rotatably connected by a spring or the like to a cross bar which extends transversely behind the arrow window of the bow and to which is releasably connected the launcher arm. The arm extends upwardly and forwardly into the arrow window of the bow and is adjustable in position in the window. The front end of the arm ends in the launching tip. The tip includes a downwardly and forwardly extending launching groove which is smooth and concave and deepens from the rear to the front thereof. The tip may be removable and the rest may be provided with a number of the tips of various groove diameters to accomodate various arrow shaft diameters. The detachable tip can be screwed into the launcher arm or can fit within an elastomeric or coiled wire sleeve in the arm which allows wear-reducing play in the tip. The tip can include a removeable outer elastomeric sleeve which also reduces tip wear. The tip can be a solid block of one piece design and manufacture. The connector block can include a radially spaced number of holes to attach a spring connecting the crossbar and block for various tensions on the arm.

7 Claims, 2 Drawing Sheets

ARCHERY ARROW REST WITH DETACHABLE LAUNCHER ARM

BACKGROUND OF THE INVENTION

1. Field of the Invention

The present invention generally relates to sport devices and more particularly to an improved type of archery arrow rest.

2. Prior Art

Various archery arrow rests have been devised for attachment to an archery bow to permit shooting an arrow therefrom with proper clearance of the bow. See, for example, U.S. Pat. Nos. 4,748,964, 4,827,895 and 5,070,855, among others.

With the advent of modern archery technology, however, many conventional arrow rests are of little use. In this regard, in an effort to increase arrow speed and thus increase the effective target size by flattening out the arrow trajectory, archery arrow manufacturers have begun to produce arrows with narrow shaft diameters and high tensile strength.

This has been accomplished through the use of resin-impregnated graphite and carbon cloth wound bi-directionally around a mandrel and heated to above the set point of the resin to form a hollow arrow shaft which is light in weight, strong and of small diameter. The newest and best shafts are reinforced by very thin-walled, hollow, high tensile strength aluminum cores to increase their consistency of spine, weight and straightness and to prevent their shattering, which can occur with either solid core or hollow unreinforced carbon and graphite arrows.

Unfortunately graphite cloth and carbon cloth have rough and abrasive exteriors due both to their weave characteristics and to the inherent physical characteristics of the carbon and/or graphite fibers from which they are made . In as much as arrows made from such cloth are fired at great speed from an arrow rest, for example at speeds of up to about 350 feet per second, considerable frictional wear of the rest occurs from contact with the exterior of the shaft.

As the rest wears, the shooting accuracy thereof decreases because the point of aim changes. Arrows critically aimed from a new rest strike the target in a location different from the location of strike on the target when the rest is worn down by friction. Moreover, rests are frequently expensive and difficult to replace. Whenever a new rest is installed, the archer must go through a tedious test period of shooting to determine the proper point of aim for different distances from the target. This tuning procedure takes much time and effort. Accordingly, archers are constantly seeking arrow rests which remain sturdy and reliable and do not require frequent replacement.

Since 1985, so-called 3-D shooting has come to the fore as a favorite pastime. Thus, 3-D shooting refers to shooting at targets which are in the form of life-like and life-sized animals such as are encountered during hunting. These targets are usually molded out of self-healing rubberized foam and are painted true colors which adds realism similar to the sport of hunting.

Such targets are placed throughout a wooded environment at random distances to accurately simulate actual encounters with bowhunting game. The distance from the bowhunter to each target must be guessed. In order to permit the bowhunter to hit the targets, the bowsight must be accurately calibrated for distances by trial and error and remain accurate. As pointed out above, this accuracy is seriously degraded when the arrow rest employed with the bow rapidly wears down, as is the case when carbon and/or graphite arrows are used. Specifically, the prong or forked tip of the rest launcher arm rapidly wears, thus causing a change in the aiming point and soon breaks down, rendering the rest useless.

There is also another consideration for arrow rests. In as much as carbon and graphite arrows are very expensive, it is desireable to employ for certain uses of the bow less expensive arrows comprising shafts of tempered aluminum or the like. However, such shafts have larger diameters than those of the previously described carbon and graphite arrows.

It is important for shooting accuracy that the arrow be closely cradled by the arrow rest so that it will not wobble in the rest or slip off the rest before it is shot therefrom. A rest designed to closely cradle a small diameter carbon or graphite arrow cannot safely support a larger diameter aluminum or wood arrow. Thus, a new rest must be installed on the bow if arrows having shafts of differing diameters are to be employed.

It would be highly desireable to be able to provide an improved archery arrow rest which could resist wear from carbon and graphite arrows and could also closely and securely cradle arrows having shafts of various diameters. Such rest should be inexpensive to make and convenient to install and use, and should also be thoroughly reliable. It should not produce arrow shaft wear to any appreciable degree and should be small enough to assure that the vanes of the arrow will not strike it during shooting of the arrow therefrom. It should also be adjustable to suit the requirements of various bow configurations, etc.

SUMMARY OF THE INVENTION

The improved arrow rest of the present invention satisfies all the foregoing needs. The rest is substantially as set forth in the ABSTRACT OF THE DISCLOSURE. For the purposes of the following discussion and detailed description, reference to carbon arrows is meant to include both carbon and graphite arrows and composite arrows also utilizing minor proportions of constituents such as boron fibers and the like, either having solid or hollow cores, the latter being unreinforced or reinforced with thin-walled aluminum tubes or the like.

Thus, the rest of the present invention features a detachable launcher arm having a smooth, hard wear-resistant launching tip of suitable material such as stainless steel, hardened aluminum, titanium, cermet, ceramic or the like which remains in its original configuration despite repeated shooting of carbon arrows therefrom. The rest further includes a mounting block or other means for mounting the rest on the sidewall of the bow opposite the arrow window. The block extends rearwardly of the bow and has a crossbar rotatably secured thereto, as by a spring.

The crossbar extends behind the bow handle to an adjustable location behind the arrow window. The launcher arm is releasably connected to the crossbar and extends forwardly and upwardly into the arrow window. The spring permits the launcher arm to pivot downwardly in response to arrow shaft pressure as the arrow is shot from the bow.

The launcher arm includes a front tip which has a downwardly and forwardly extending front launching groove designed to closely cradle the arrow shaft. In this regard, the groove is preferably concave and smooth, and deepens from the upper rear end thereof to the lower front end thereof. The launching groove is hard enough to resist wear from the carbon arrow shaft.

In a preferred embodiment the tip is removeable and the rest is provided with a plurality of the tips, each having a different groove diameter so as to accomodate arrow shafts of differing diameters. In the unlikely event that the tip does wear, it also can be easily replaced without removing the launcher arm or the rest from the bow.

The removeable tip can have a narrow diameter elongated rear portion which can be screwed or slid or the like into an elongated hole in the front of the launcher arm which , if desired, can be lined with a replaceable elastomeric sleeve so as to allow wear-reducing play in the tip during shooting of the arrow. The tip can also be fitted with a replaceable protective elastomeric sleeve, if desired. The tip can be a solid block of material, for example, a half tube which provides the desired concave, arrow shaft-cradling channel therein.

If desired, the connector block which secures the rest to the bow can include means for adjusting the tension of the spring, for example, a plurality of spaced holes into which the spring can be removeably seated.

Further features of the present invention are set forth in the following detailed description and accompanying drawings.

DRAWINGS

Figure 5A:
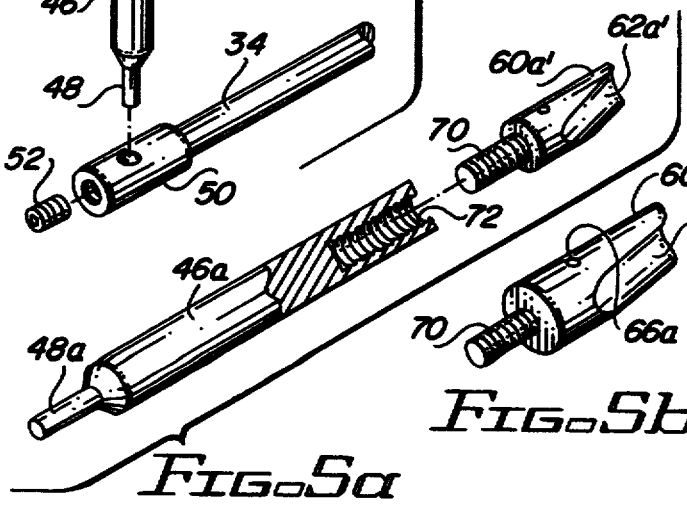
Figure 5B:
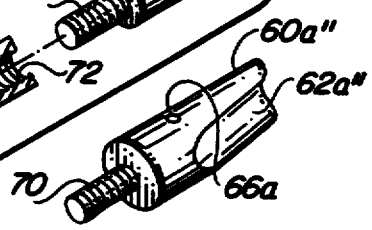
Figure 5C:
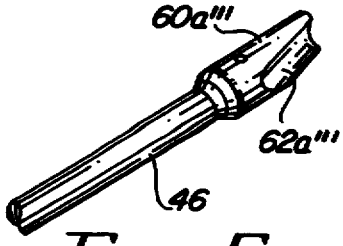
Figure 6:
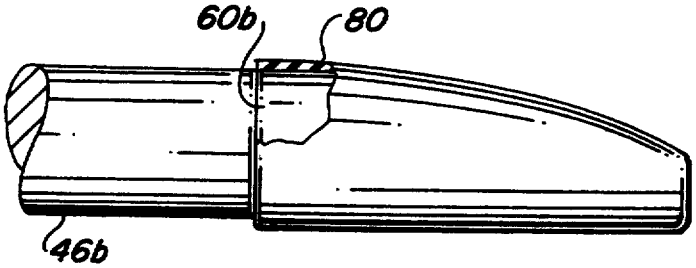
Figure 7:
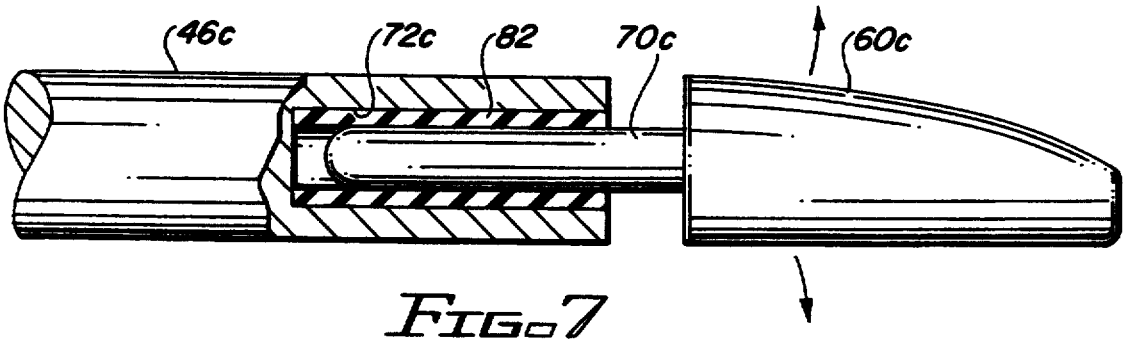
Figure 8:
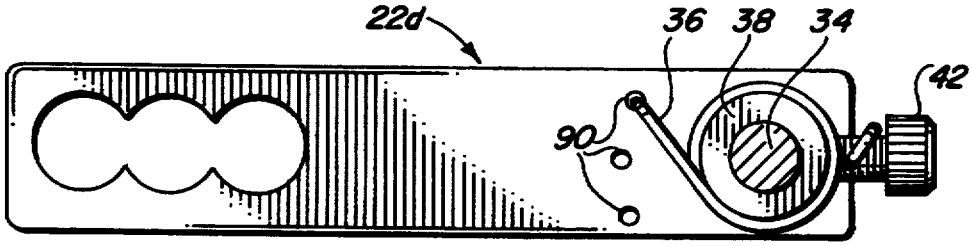
Figure 9:
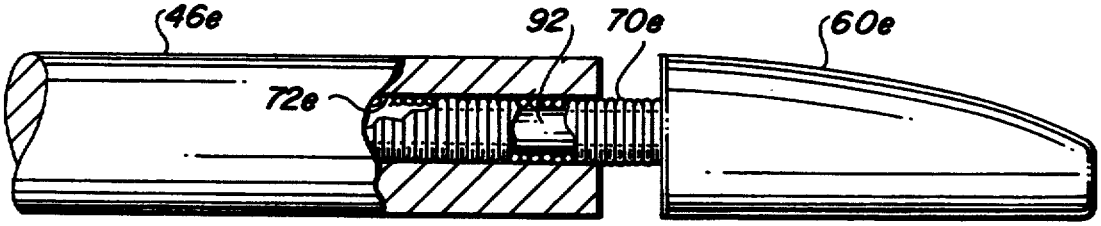

FIG. 5 is an enlarged schematic perspective view, partly broken away, of a second preferred embodiment of the launcher arm of the rest of the present invention, showing detachable tips for the arm, specifically view (*a*) in the form of a carbon arrow-receiving tip, view (*b*) in the form of an aluminum arrow-receiving tip, and view (*c*) in the form of an aluminum arrow-receiving tip, with mating beveled surfaces for the launcher arm and tip;

FIG. 6 is an enlarged fragmentary schematic side elevation of a third preferred embodiment of the launcher arm of the rest of the present invention, showing the tip thereof with a removeable elastomeric sheath disposed thereover;

FIG. 7 is an enlarged fragmentary schematic side elevation, partly broken away,of a fourth preferred embodiment of the launcher arm of the rest of the present invention, shown with the rear end of the detachable tip thereof slidably received within an elastomeric sleeve in the front end of said arm;

FIG. 8 is an enlarged schematic side elevation of a modified version of the mounting block of the rest of the present invention; and, FIG. 9 is a schematic side elevation, partly broken away, of a fifth preferred embodiment of the launcher arm of the rest of the present invention.

DETAILED DESCRIPTION

FIGS. 1–4.

Figure 1:
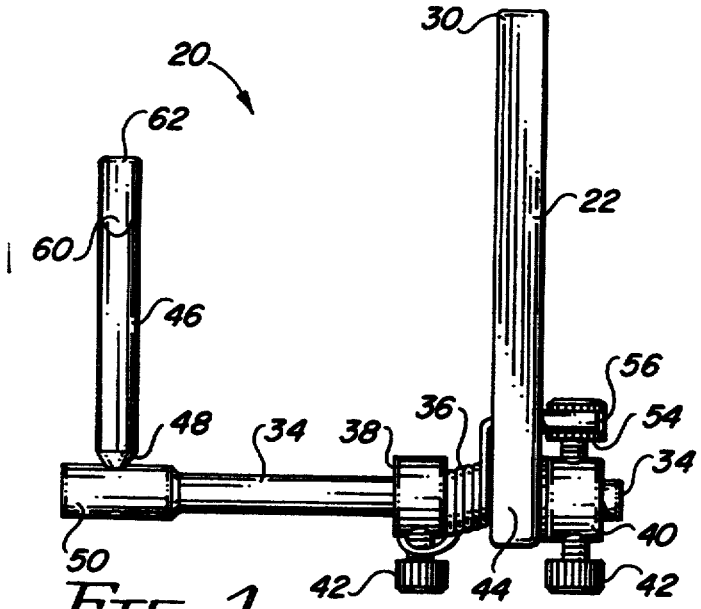
FIG. 1 is a schematic top plan view of a first preferred embodiment of the improved archery arrow rest of the present invention.
Figure 2:
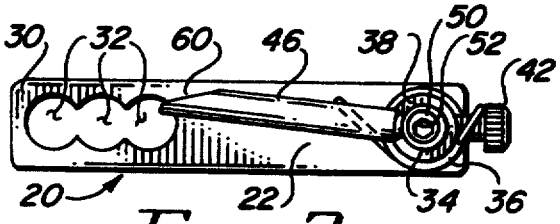
FIG. 2 is a schematic left side elevation of the rest of FIG. 1.
Figure 3:
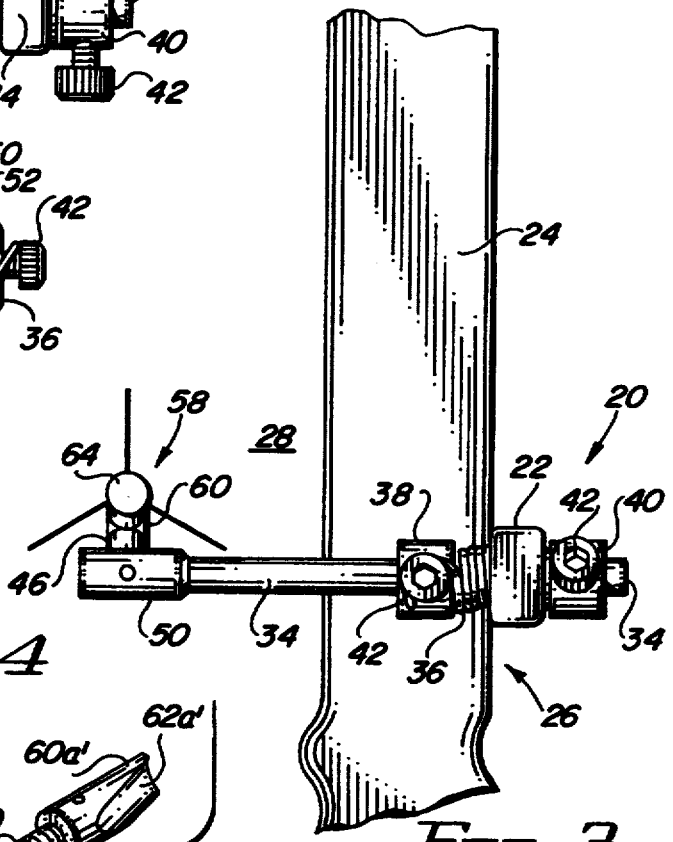
FIG. 3 is a schematic rear elevation of the rest of FIG. 1, shown mounted on an archery bow and with an arrow in place on said rest.
Figure 4:
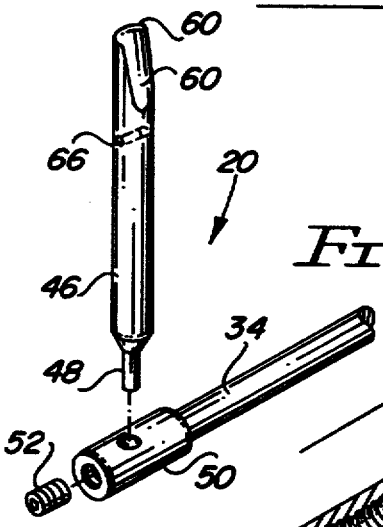
FIG. 4 is a fragmentary schematic perspective view of the launcher arm and crossbar of the rest of FIG. 1, shown with the launcher arm removed from the crossbar.

Now referring to FIGS. 1–4, a first preferred embodiment of the improved arrow rest of the present invention is schematically depicted therein. Thus, rest 20 is shown which includes a generally horizontal elongated block 22 adapted for releasably mounting rest 20 on the vertical sidewall 24 of an archery bow 26 opposite the arrow window 28 thereof (FIG. 3). The front portion 30 of block 22 may have a plurality of overlapping transverse holes 32 therethrough, so that a transverse screw or bolt (not shown) can pass therethrough and also through sidewall 24 to secure rest 20 in place. It will be understood that any other suitable means for anchoring rest 20 to bow 26 can be used in place of block 22, if desired.

Rest 20 also includes a transverse crossbar 34 pivotally secured as by a spring 36 and collars 38 and 40 with threaded locking nuts 42, to the rear end 44 of block 22. One end of spring 36 is wrapped around nut 42 on collar 38, the body of spring 36 is wrapped around crossbar 34 and the opposite end of spring 36 is releasably inserted into end 44 of block 22. Crossbar 34 extends behind bow 26 to a point behind arrow window 28 and is adjustable transversely, passing through block 22 and adjustably held by collars 38 and 40, to accomodate bows of various configurations, etc.

An elongated launcher arm 46 is releasably secured at its narrowed rear end 48 to the free end 50 of crossbar 34, as by a threaded screw 52 intersecting end 48 in end 50. Launcher arm 46 extends upwardly and forwardly into arrow window 28. Collar 40 has a front nut 54 which intercepts a pin 56 extending laterally from block 22 to limit upward rotation of launcher arm 46 by spring 36 while permitting downward rotation of launcher arm 46 against spring 36 by the depressing force of arrow 58 when shot from bow 26.

The front end of launcher arm 46 has a tip 60 which has a smooth concave arrow shaft-receiving groove 62 therein which slopes downwardly and increases in depth from the upper rear end thereof to the lower front end thereof. Groove 62 closely cradles shaft 64 of arrow 58 to prevent it from shifting position and rolling off of tip 60 before shooting of arrow 58 from bow 26. At least tip 60 and preferably all of launcher arm 46 is fabricated of a solid block of wear-resistant metal, such as stainless steel, hardened aluminum, titanium or the like, or a cermet or ceramic or the like designed to prevent shaft 64 from wearing tip 60 despite continued use of tip 60 over an extended period of time and even when arrow 58 is projected therefrom at great speed.

Launcher arm 46 may have a transverse keyhole 66 behind tip 60 which keyhole 66 permits a key (not shown) to be releasably inserted therein to twist the tip to the proper orientation after launcher arm 46 is pinned in end 50 of crossbar 34.

Accordingly, rest 20 is suitable for use with abrasive carbon arrows and the like. If tip 60 ever needs replacement, launcher arm 46 can merely be detached from rest 20 and can be replaced. This is much more convenient than substituting an entire rest, as with conventional rests.

Rest 20 can be made of conventional materials, except for the smooth hard tip 60 and is inexpensive, easy to install and use as well as repair and replace. The great durability of tip 60 assures shooting accuracy over an extended period of time. It will be understood that launcher arm 46 with tip 60 can be used in rests which have a different configuration than that shown for rest 20.

FIG. 5.

A second preferred embodiment of the launcher arm of the present invention is schematically depicted in FIG. 5. Thus, launcher arm 46*a* is shown which is substantially identical to launcher arm 46, except as follows: Launcher arm 46*a* differs from launcher arm 46 only in that tip 60*a* thereof is detachable from arm 46*a*. Three versions of tip 60*a* are shown. In each instance tip 60*a* includes a threaded rear portion 70 which is threadably received in a threaded recess 72 in the front end of launcher arm 46*a*.

In version (*a*), tip 60*a*′ is dimensioned to accept carbon arrow shafts. In version (*b*), tip 60*a*″ is dimensioned to accept larger diameter aluminum and wooden arrow shafts and the like. In version (*c*), tip 60*a*‴ is dimensioned similarly to tip 60″, but further includes beveling on the rear end thereof and the front end of launcher arm 46*a* ‴ which assures a tight fit between those two components.

Tip 60*a* can be even more easily replaced than launcher arm 46*a*, and thus is more convenient. The rest of the present invention can be provided with a plurality of tips 60*a* of various diameters to accomodate arrow shafts of various diameters without having to replace the entire rest, a distinct advantage over the prior art.

FIG. 6.

A third preferred embodiment of the improved launcher arm used in the rest of the present invention is schematically depicted in FIG. 6. Thus, arm 46*b* is shown, which is identical to arm 46 and tip 60, except that tip 60*b* is releasably covered with a removeable elastomeric sheath to further reduce wear. Arm 46*b* and tip 60*b* thereof have the other advantages of arm 46 and tip 60.

FIG. 7.

A fourth preferred embodiment of the launcher arm and tip of the present invention is schematically depicted in FIG. 7. Thus, arm 46*c* and removeable tip 60*c* are shown, which differ from arm 46*a* and tip 60*a* only in that rear end 70*c* of tip 60*c* is not threaded nor is recess 72*c*. Instead, smooth end 70*c* is slideably received in recess 72*c* which is lined with an elastomeric sheath 82 which permits a little play in tip 60*c* during shooting of an arrow therefrom. This has the effect of further suppressing wear of tip 60*c*.

FIG. 8.

FIG. 8 is a schematic side elevation of a modified version of the mounting block used with rest 20. Thus, block 22*d* is shown, which can be substituted for and differs from block 22 only in providing a series of three transverse holes 90 set in a radial pattern and into any one of which the free end of spring 36 can be releasably held in order to change the tension exerted by spring 36 on crossbar 34, as previously described in connection with FIGS. 1–4.

FIG. 9.

A fifth preferred embodiment of the launcher arm utilized in the rest of the present invention is schematically depicted in FIG. 9. Thus, launcher arm 46*e* is shown which can be substituted for launcher arm 46. Arm 46*e* has a removeable tip 60*e* with a rear portion comprising an elongated coiled spring 72*e* which is slideably received in frictional engagement with recess 72*e*, as shown in FIG. 9. Spring 70*e* permits some play in tip 60*e* to reduce tip wear during launching of an arrow therefrom. If desired, spring 70*e* can be disposed around a central elongated cylindrical core 90 integral with tip 60*e*.

Various other modifications, changes, alterations and additions can be made in the improved archery arrow rest of the present invention, its components and parameters. All such modifications, changes, alterations and additions as are within the scope of the appended claims form part of the present invention.

What is claimed is:

1. An improved archery arrow rest with detachable launcher arm, said rest comprising, in combination:
   a) an elongated rearwardly extending block having a front end defining means for attaching said arrow rest to the sidewall of an archery arrow bow opposite the arrow window of said bow, and an opposite rear end;
   b) a transversely extending crossbar having one end thereof pivotally connected to said block adjacent said rear end of said block and extending laterally thereof with the opposite end thereof being releasably positionable behind said arrow window; and,
   c) a removable arrow launcher arm, the rear end thereof being releasably connected to said crossbar at said opposite end of said crossbar and extending forwardly of said crossbar into said arrow window, the front end of said launcher arm having a launching tip, said tip being detachable from said launcher arm for replacement thereof, said tip being threadably connected to said launcher arm and having a downwardly sloping arrow-receiving launching groove at the front end of said tip, said tip groove increasing in depth from the upper rear end thereof to the lower front end thereof, said groove being generally concave for seating an arrow shaft therein, said tip comprising wear-resisting material capable of retaining its size and shape upon repeated contact with an abrasive arrow.

2. The improved arrow rest of claim 1 wherein said tip includes a transverse hole behind said groove for facilitating screwing said tip into said launcher arm with the aid of a turnkey.

3. The improved arrow rest of claim 1 wherein the rear surface of said tip and the front surface of said launcher arm are beveled to facilitate proper alignment thereof.

4. The improved arrow rest of claim 1 wherein said launcher arm is adjustably spring baised into a forwardly and upwardly inclined position by a spring adjustably interconnecting said crossbar and block and wherein said block includes a plurality of spaced holes into which one end of said spring can be releasably secured for said adjustment.

5. An improved archery arrow rest with detachable launcher arm, said rest comprising, in combination:
   a) an elongated rearwardly extending block having a front end defining means for attaching said arrow rest to the sidewall of an archery arrow bow opposite the arrow window of said bow, and an opposite rear end;

b) a transversely extending crossbar having one end thereof pivotally connected to said block adjacent said rear end of said block and extending laterally thereof with the opposite end thereof being releasably positionable behind said arrow window; and, c) a removable launcher arm, the rear end thereof being releasably connected to said crossbar at said opposite end of said crossbar and extending forwardly of said crossbar into said arrow window, the front end of said launcher arm having a launching tip, said tip being detachable from said launcher arm for replacement thereof, said tip having a downwardly sloping arrow-receiving launching groove at the front end of said tip, said tip groove increasing in depth from the upper rear end thereof to the lower front end thereof, said groove being generally concave for seating an arrow shaft therein, said tip comprising wear-resisting material capable of retaining its size and shape upon repeated contact with an abrasive arrow, said arrow rest including a plurality of said detachable tips of various groove diameters to accomodate arrows of various shaft diameters.

6. The improved arrow rest of claim 5 wherein the rear end of said tip is receivable within an elastomeric-lined hole in the front of said launcher arm so that said tip has play in it to reduce tip wear during launching of an arrow therefrom.

7. The improved arrow rest of claim 5 wherein the rear end of said tip is connected to an elongated coiled spring receivable within a longitudinal hole in the front of said launcher arm to resist wear of said tip during launching of an arrow therefrom.

* * * * *